US010639685B2

(12) United States Patent
James et al.

(10) Patent No.: US 10,639,685 B2
(45) **Date of Patent: *May 5, 2020**

(54) METHOD FOR MAINTAINING SOLIDS IN SUSPENSION IN BULK STORAGE TANKS

(71) Applicants: Michael Henry James, Maringouin, LA (US); Michael William O'Rourke, Port Allen, LA (US)

(72) Inventors: Michael Henry James, Maringouin, LA (US); Michael William O'Rourke, Port Allen, LA (US)

( * ) Notice: Subject to any disclaimer, the term of this patent is extended or adjusted under 35 U.S.C. 154(b) by 348 days.

This patent is subject to a terminal disclaimer.

(21) Appl. No.: 15/441,394

(22) Filed: Feb. 24, 2017

(65) Prior Publication Data

US 2017/0157576 A1 Jun. 8, 2017

Related U.S. Application Data

(63) Continuation-in-part of application No. 14/293,804, filed on Jun. 2, 2014, now Pat. No. 9,592,542, and a (Continued)

(51) Int. Cl.
*B08B 9/093* (2006.01)
*B01F 5/10* (2006.01)

(Continued)

(52) U.S. Cl.
CPC ..... *B08B 9/0933* (2013.01); *B01F 5/10* (2013.01); *B65D 90/0093* (2013.01);

(Continued)

(58) Field of Classification Search
CPC ..... B08B 9/08; B08B 9/093; B08B 9/0933; B08B 9/0817; B65D 90/0093; B01F 5/10
See application file for complete search history.

(56) References Cited

U.S. PATENT DOCUMENTS 3,158,358 A 11/1964 Fischer
3,216,570 A * 11/1965 Cunetta ..... B01D 21/2427 210/803

(Continued)

FOREIGN PATENT DOCUMENTS

CN 201239613 5/2009
GB 2353230 B * 3/2003 ..... B01F 5/0218
JP S53110258 A * 9/1978

OTHER PUBLICATIONS

"Tanksweep" Webpage, www.nonentry.co.uk, dated Aug. 29, 2010 (available at http://web.archive.org/web/20100829075334/http://www.nonentry.co.uk/tanksweep_tankcleaning_kit.htm). (Year: 2010).*

(Continued)

*Primary Examiner* — Michael E Barr
*Assistant Examiner* — Kevin G Lee

(57) ABSTRACT

A method for maintaining solids and heavy liquids in fluid suspension within a bulk storage tank includes providing a nozzle and suction assembly mounted to a storage tank sidewall having a horizontally extending discharge pipe and a suction pipe for recirculation of the emulsion of fluids within the storage tank. The discharge pipe and suction pipe can be extended to the tank floor and configured with a bend to extend along the tank sidewall to which is attached a submersible swivel joint fitted with a choked nozzle. The nozzle and suction assembly produce positive and vacuum pressure, respectively, for causing the simultaneous discharge and suction of contained tank fluids to cause recirculation. The nozzle may be adjusted so the direction of flow may follow the angle of the tank floor.

4 Claims, 9 Drawing Sheets

Related U.S. Application Data continuation-in-part of application No. 13/456,746, filed on Apr. 26, 2012, now abandoned.

(51) Int. Cl.

| | |
|---|---|
| ***B65D 90/00*** | (2006.01) |
| *B01F 5/02* | (2006.01) |
| *B05B 14/00* | (2018.01) |
| *B05B 15/652* | (2018.01) |
| *B05B 13/06* | (2006.01) |
| *B05B 13/04* | (2006.01) |

(52) U.S. Cl.

CPC ..... *B01F 5/0206* (2013.01); *B01F 2215/005* (2013.01); *B05B 13/0405* (2013.01); *B05B 13/0636* (2013.01); *B05B 14/00* (2018.02); *B05B 15/652* (2018.02)

(56) References Cited

U.S. PATENT DOCUMENTS

| | | | | |
|---|---|---|---|---|
| 4,042,220 | A | 8/1977 | Humkey et al. | |
| 4,100,610 | A | 7/1978 | Johnston et al. | |
| 4,249,828 | A | 2/1981 | Condolios | |
| 4,577,972 | A | 3/1986 | Shuck et al. | |
| 4,618,426 | A | 10/1986 | Mandt | |
| 4,827,563 | A * | 5/1989 | Gordon | A47L 9/06 134/167 R |
| 5,445,173 | A * | 8/1995 | Aiken | B01F 5/0206 134/167 R |
| 5,605,105 | A | 2/1997 | Clark et al. | |
| 5,620,250 | A | 4/1997 | Chilcoat et al. | |
| 5,810,473 | A * | 9/1998 | Manabe | B08B 9/0933 134/167 R |
| 6,125,865 | A * | 10/2000 | Bacon Cochrane | B08B 9/0933 134/169 R |
| 6,234,664 | B1 | 5/2001 | Tromley | |
| 6,481,885 | B2 | 11/2002 | Dupre | |
| 7,025,492 | B2 | 4/2006 | Dorsch et al. | |
| 7,726,870 | B1 | 6/2010 | Lott | |
| 8,083,395 | B2 | 12/2011 | Etzenbach | |
| 8,157,432 | B2 | 4/2012 | Tysse et al. | |
| 8,734,004 | B2 * | 5/2014 | Steffler | B01F 5/0218 366/142 |
| 8,790,001 | B2 | 7/2014 | Lamon | |
| 9,114,367 | B1 | 8/2015 | Thomas et al. | |
| 2010/0264093 | A1 * | 10/2010 | Ralph | B01D 21/0006 210/738 |
| 2010/0271902 | A1 | 10/2010 | Braden | |
| 2011/0180152 | A1 | 7/2011 | Dorsch | |
| 2013/0224358 | A1 | 8/2013 | Michel et al. | |
| 2015/0059867 | A1 | 3/2015 | Stroh et al. | |
| 2015/0336822 | A1 | 11/2015 | Adams et al. | |

OTHER PUBLICATIONS

Solid-Liquid Mixing in Mechanically Agitated Vessels, Andrew Mak, Jun. 1992.

* cited by examiner

METHOD FOR MAINTAINING SOLIDS IN SUSPENSION IN BULK STORAGE TANKS

PRIORITY

This is a continuation-in-part application under 37 CFR 1.53(b) entitled "Method and Apparatus for Maintaining Solid in Suspension in Bulk Storage Tanks". The pending prior application is Ser. No. 14/293,804 filed on Jun. 2, 2014 by applicants for "Method and Apparatus for Cleaning the Interior of an above Ground Storage Tank", the entire contents of which are hereby incorporated by reference. This application claims priority to prior application Ser. No. 14/293,804 and its parent application Ser. No. 13/456,746 filed on Apr. 26, 2012.

FIELD OF INVENTION

This invention relates to bulk tank storage of liquids containing suspended solids such as bulk storage of paints, varnishes and stains. More particularly, the application relates to an apparatus for maintaining the solids in suspension with the stored liquids in the interior of an above ground storage tank. The apparatus includes an articulating recirculation assembly that may be permanently or temporarily attached to the sidewall of the storage tank.

BACKGROUND OF THE INVENTION

The field of mixing paints and other liquids is aimed at employing some form of agitating mechanism for stirring and mixing liquids containing solids so as to hold such solids evenly and uniformly distributed in suspension within the liquid. Agitation is necessary when dealing with the long term storage of such things as paints, varnishes, stains, shellac, enamels, and the like which are an emulsion of, among other things, fine solid particles, binders composed of oil or resin, thinners and organic or water solvents which, if left unperturbed for an extended period of time, the heavier solids and components, having higher densities in the emulsion, would soon begin to settle at the bottom of any container in which they are left.

When paint or other liquid jet is left to settle, the dense solid components and heavier liquids can become a thick mud-like sludge at the bottom of the storage container. Such effect is commonly found with commercial paint and varnish products which, in order to prepare the emulsion for its intended purpose, require a considerable amount of stirring to evenly redistribute and suspend the solids within the liquid component before application. In short term mixing prior to use, such method to re-suspend the mixture with smaller quart, pint, and gallon containers presents some time and effort but remains manageable.

Yet, in the larger long term storage tanks holding countless gallons of the emulsion prior to its distribution within smaller containers, such sludge can build up to an unmanageable degree. In less serious cases the storage container may require considerable time and money to break up the sludge and re-suspend the emulsion evenly. In the more serious circumstances the entire emulsion may be required to be discarded due to the buildup, sometimes damaging the storage container or even necessitating the scrapping of the storage container itself. Consequently, it is preferable to constantly or periodically agitating the emulsion so as to prevent the buildup of sludge in the tanks.

Due to the extreme size of the storage tanks and the massive volume of fluid contained therein, a number of mechanical devices are utilized for facilitating the agitation of tanks without the necessity of having a worker enter the tank. Such devices employ large articulating paddles or rotary blade impellers positioned at the top or the sides of the tanks to impart stirring to the emulsion. These devices typically employ rotaries or gimbals mounted to the side of the tank to allow for the rotation of the agitators within the emulsion. When positioned from the top, such devices cause fluid, and suspended solids, to be projected at high velocities down against the tank floor which can cause ear on the tank integrity and drive the heavy solids to the bottom, creating sludge. When positioned from the sides, such devices fail to sufficiently circulate the fluid at the tank floor which typically has a slight downward slope towards its center, thus leaving a substantial portion of the tank undisturbed where sludge can form. As well, agitators designed to be rotated within the tank can become stuck in settled sludge or locked up by sludge which has been disengaged from the tank floor wherein the paddle or rotary blade will no longer be allowed to rotate.

Methods of mixing other fluids containing particulate matter such as in the fields of tank cleaning, waste management, and separating oil-water emulsions employ jet nozzles in order to produce high velocities of fluids into tanks in order to scour the inside of the tank or mix the contained emulsion with treated fluids, such as water of detergent. Though, such methods are not conducive to that of mixing paints, varnishes, stains, shellac, enamels, and the like which must be maintained in their present mixture of components. Addition of external fluids into the tank would dilute the contained mixture, ruining the product. Further, recirculation of the contained fluid mixture is unfavorable as the tank emulsion contains solids and heavier density fluids. Attempting to drive mixing through recirculation, wherein the contained fluid and solids are suctioned into and pumped out of a recirculating device, clogs up the nozzles, pipes, and pumps of the recirculating device causing breakages and failures to properly mix.

A need exists for a simple, user controlled propulsion recirculation device that may be deployed within the interior of an above ground storage tank to maintain suspension of solids and heavy liquids within the mixture.

SUMMARY OF THE INVENTION

The present invention provides a simple, user controlled method for deploying a nozzle within the interior of a bulk storage tank of liquids containing suspended solids. The method described includes providing an articulating recirculation assembly. The recirculation assembly may be adapted for permanent attachment in a manway cover attached in the vertically extending sidewall of the storage tank or for attachment into a separate hatch or port positioned in the vertically extending sidewall of the storage tank.

The articulating recirculation assembly may be comprised of a horizontally extending discharge pipe and a horizontally extending suction pipe fixedly mounted to the vertically extending exterior sidewall of a storage tank. The discharge pipe extends through the tank sidewall so that the discharge pipe has an exterior portion extending from the storage tank sidewall on the outside of the storage tank and an interior portion extending from the storage tank sidewall on the inside of the storage tank. The exterior portion of the discharge pipe has an exterior end configured for attachment to and fluid communication with a high pressure recirculation pump connected to a collection reservoir. The interior portion of the discharge pipe is configured to have a desired bend so that discharge pipe will generally extend along the vertically extending tank sidewall. The interior pipe may be vertically adjusted downward so that it will sweep just above the tank floor.

The suction pipe extends through the tank sidewall so that the suction pipe has an exterior portion extending from the storage tank sidewall on the outside of the storage tank and an interior portion extending from the storage tank sidewall on the inside of the storage tank. The exterior portion of the suction pipe has an exterior end configured for attachment to and fluid communication with a high pressure vacuum source connected to the collection reservoir. The interior portion of the suction pipe may also be configured to have a desired bend so that suction pipe extends along the vertically extending tank sidewall. The interior portion of the suction pipe may be vertically adjusted downward so that it will sweep just above the tank floor.

When used with a tank containing an evenly distributed fluid-solids emulsion, the suction pipe is may be used to apply a vacuum suction around the interior of the tank to draw the fluids and solids into the collection reservoir, wherein the high pressure recirculation pump may then drive the fluid back through the nozzle. In use where the emulsion has been allowed to settle forming sludge at the bottom of the tank, the suction pipe may dram in the adherent sludge from around the recirculation assembly, to be agitated within the collection reservoir, and discharged through the nozzle back into the tank solution to further break up the adherent sludge and mix back within the fluid medium.

A submersible swivel joint, such as a Chiksan® swivel joint manufactured by FMC Technologies, Inc., is attached at the end of the interior portion of the discharge pipe and the suction pipe to provide a fluid discharge end to the discharge pipe that extends generally perpendicular to the vertically extending tank sidewall. The discharge pipe discharge end of the discharge pipe is fitted with a choked nozzle. In this configuration, the choked nozzle will rotate about the centerline of the discharge pipe by means of the swivel joint. Similarly, the suction pipe suction end may be fitted with a suction nozzle or funnel to direct the material being vacuumed into the suction pipe.

The discharge pipe and the suction pipe of the recirculation assembly may each be further provided with a control assembly so that the rotation of the choked nozzle about the centerline of the discharge pipe and the suction funnel of the suction pipe can be manipulated from the exterior of the storage tank. The choked nozzle may also be offset at a small angle to follow the contour slope of the tank floor. The control assembly is generally comprised of a control bushing mounted in the sidewall of the storage tank at a position adjacent to the exterior portion of the discharge pipe. The control bushing is fitted with a rotatable control shaft that has an exterior end extending generally perpendicular from the vertically extending sidewall of the storage tank and an interior end that extends into the interior of the storage tank. The interior end of the control shaft is fitted with a perpendicularly extending rod or bar fitted to a steering linkage. Exterior end of the control shaft is fitted with a crank or steering wheel to facilitate rotation of the rotatable control shaft.

The control shaft with its associated steeling linkage is utilized to rotatable control the position of the choked nozzle and suction funnel with respect to the swivel joint. The associated steering linkage can be any suitable linkage such as linkage associated with an eccentric gear drive, rack and pinion, cam, or wheel mechanisms. Articulation of the control shaft to adjust the angle of the discharge pipe and nozzle allows for recirculated fluid to be directed at desired angles to impart agitation within the tank. Functioning as such, the method of using an articulable high pressure discharge nozzle may be implemented to cause a swirl or vortex within the tank mixture, facilitating maintaining the even distribution of the solids and heavy liquids within the emulsion.

DESCRIPTION OF EMBODIMENT

Figure 1:
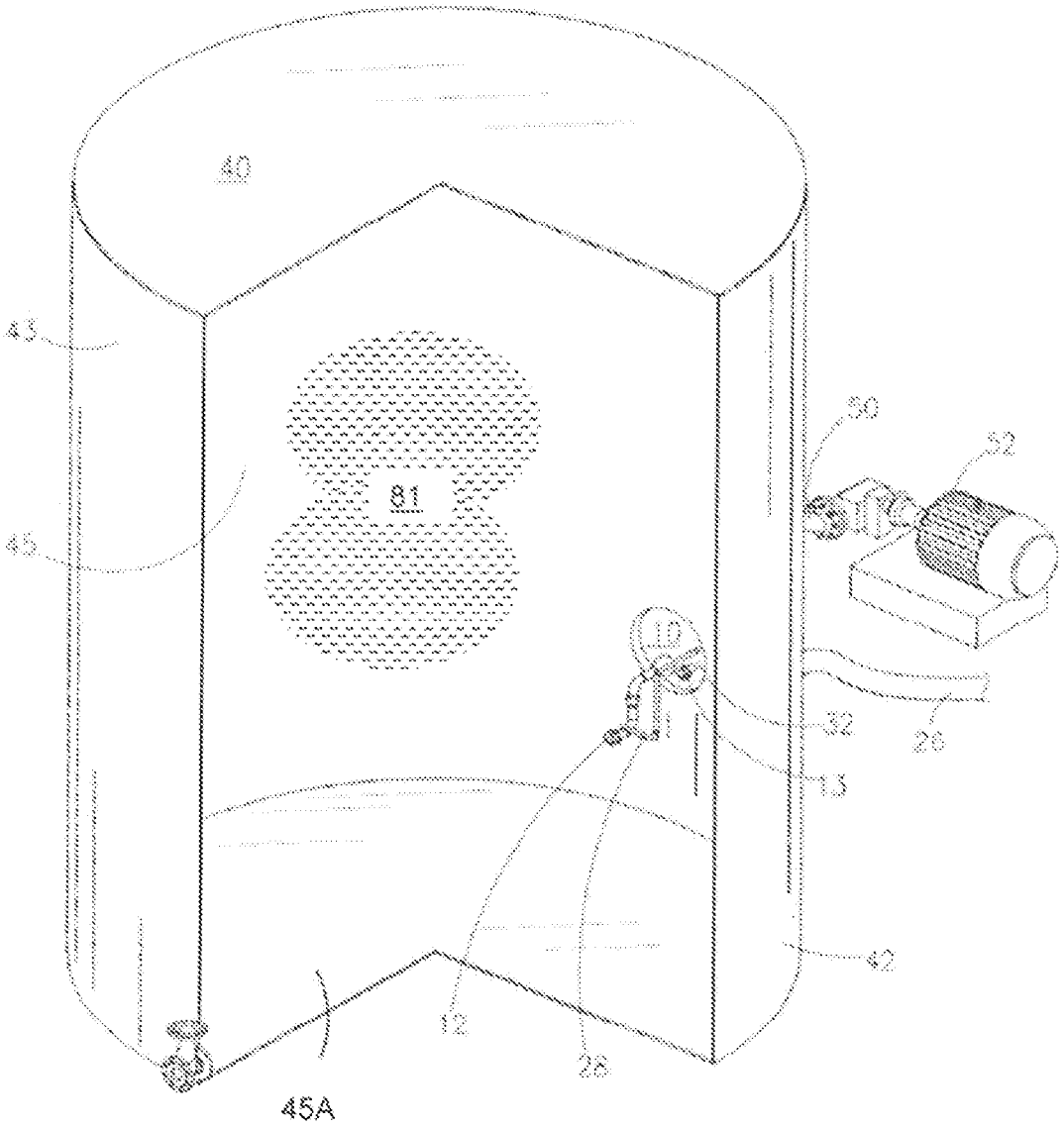
FIG. 1 is a cutaway perspective view of a storage tank fitted with the articulating recirculation assembly described herein.

FIG. 1 shows a cutaway perspective view of an above ground storage tank (40) having tank contents (81) a solids and liquids suspension (81). Tank (40) has a vertically extending sidewall (42) that separates the tank exterior (43) from the tank interior (45) and a tank floor (45A). The sidewall (42) of the storage tank (40) is fitted with one embodiment of an articulating recirculation assembly (10) for circulating, mixing, and maintaining the tank contents (81) in suspension. Recirculation assembly (10) is comprised of a nozzle section (12), a suction section (13), and a nozzle steering or control assembly (14).

Figure 2:
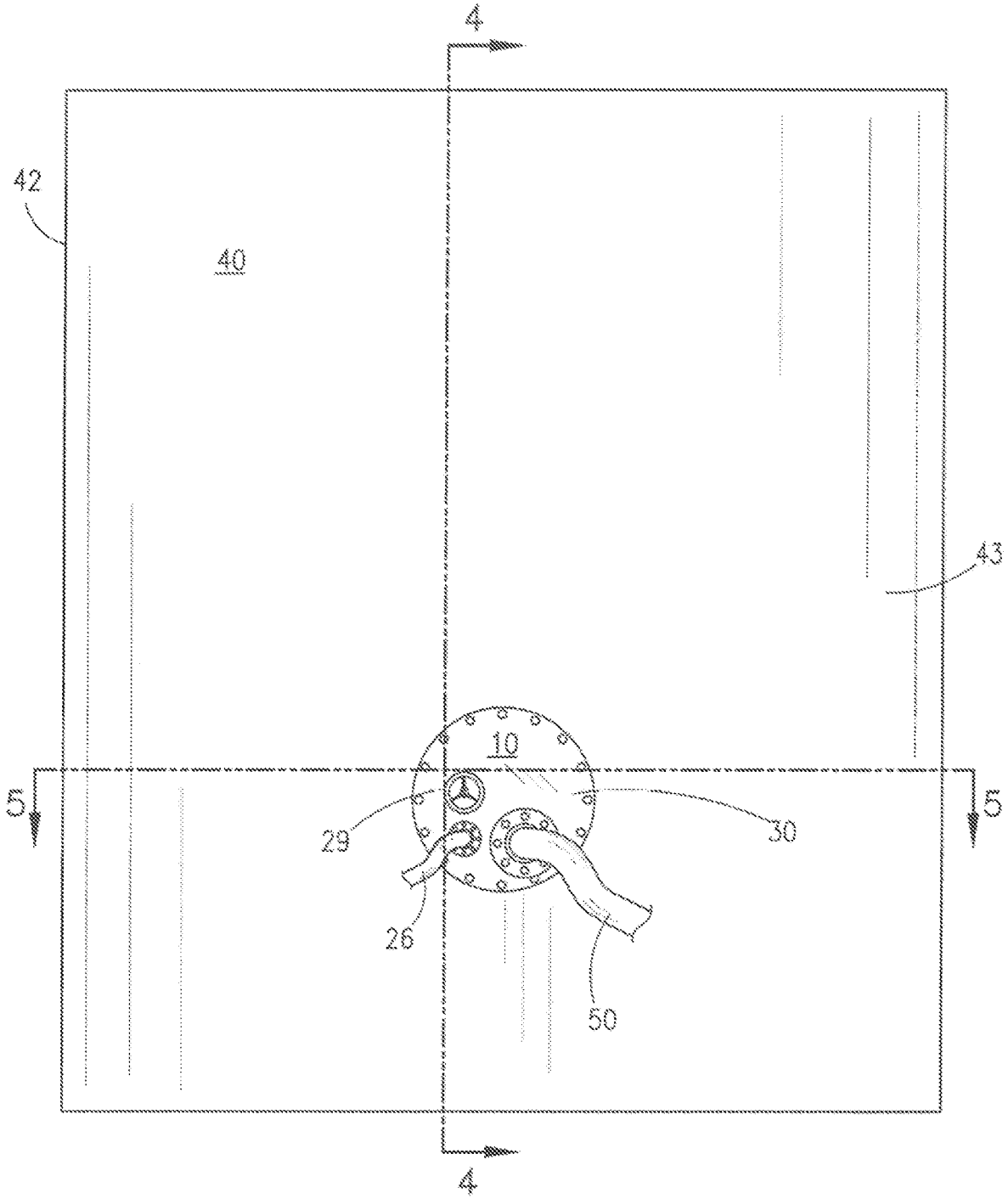
FIG. 2 is an outside elevation view of the above ground storage tank mixing assembly shown in FIG. 1.
Figure 3:
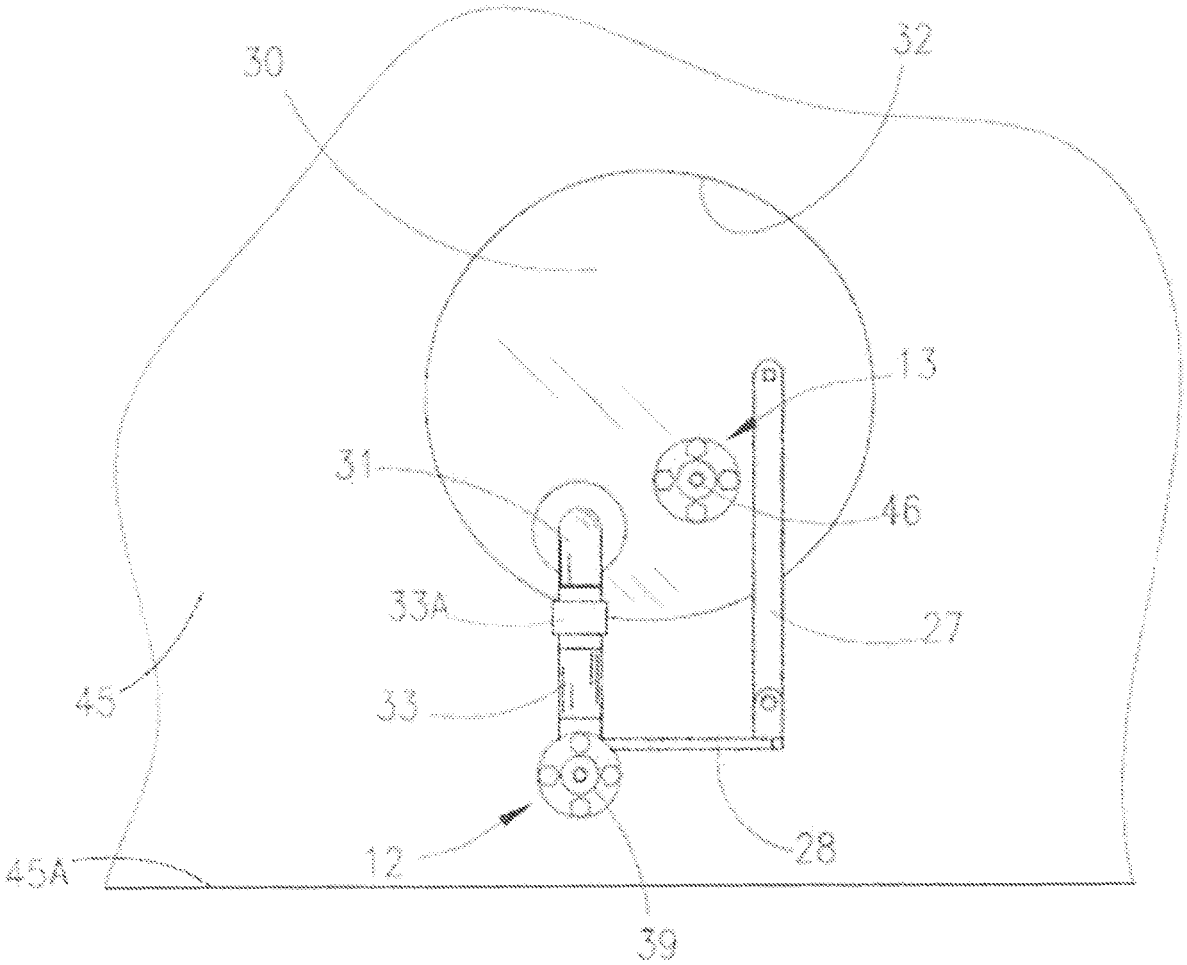
FIG. 3 is an interior elevation view of the above ground storage tank mixing assembly shown in FIG. 1.

The recirculation assembly (10) may be permanently or removably fitted on the storage tank (40) by attachment to a manway cover, hatch, or port (30) of an opening (32) in the sidewall (42) of the storage tank (40) as shown in FIGS. 2 and 3. The recirculation assembly (10) may also be permanently or removably fitted on the storage tank (40) by attaching it to a separate hatch, port cover, or other opening positioned in the vertically extending sidewall (42).

The nozzle section (12) of the assembly (10) is fitted to a high pressure fluid supply line (50) that is attached to a collection reservoir (62) and pump system (52) so that recirculated fluid may be injected into the storage tank (40). The suction section (13) is attached to a vacuum system (54) which recirculates suctioned fluids to the collection reservoir (62) and pump system (52).

Figure 4:
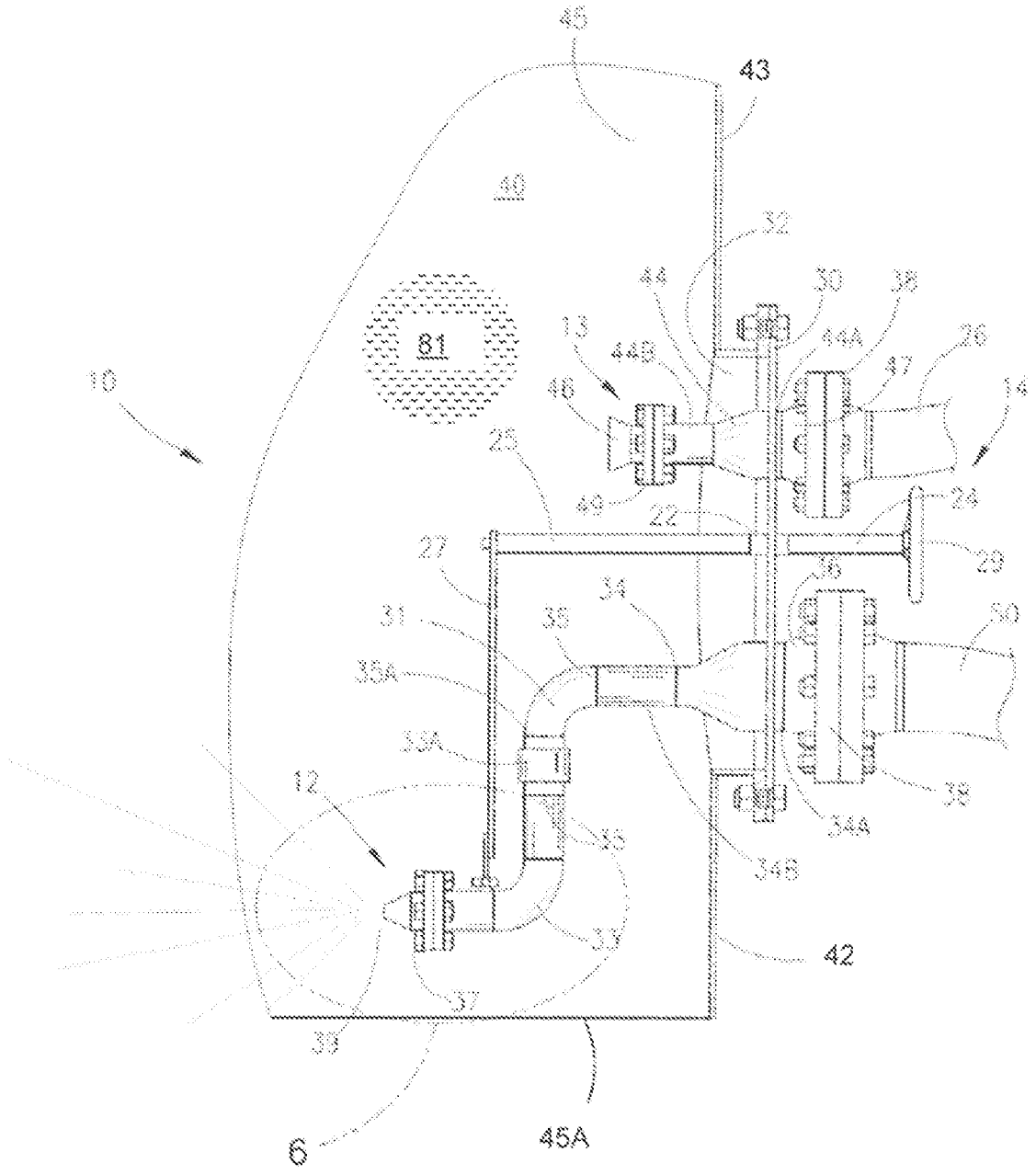
FIG. 4 is a side partial cross-section view of the above ground storage tank mixing assembly shown in FIG. 1.

FIG. 4 shows a side partial cross-section view of the storage tank (40) with the tank sidewall fitted with the articulating recirculation assembly (10). In the interest of clarity, suction section (13) is shown at a position above nozzle section (12) though suction section (13) will be preferably positioned on the tank sidewall at a position in line with or below nozzle section (12) as needed in order to achieve adequate suction of tank contents (81), such contents being light and heavy fluids, any adherent sludge settled at the tank (40) floor, as well as the emulsion of the two.

The nozzle section (12) of the recirculation assembly (10) is comprised of a horizontally extending discharge pipe (34) that is fixedly mounted to the vertically extending sidewall (42) of the storage tank (40). The discharge pipe (34) extends through the tank sidewall (42) so that the discharge pipe (34) protrudes into the interior (45) of the storage tank (40) in a direction generally perpendicular to the tank sidewall (42) and has an exterior portion (34A) that extends away from the storage tank sidewall (42) on the tank exterior (43) of the storage tank (40) and an interior portion (34B) that extends from the storage tank sidewall (42) into the tank interior (45) of the storage tank (40).

The exterior portion (34A) of the discharge pipe (34) has an exterior end (36) configured for attachment to and fluid communication with the high pressure fluid line (50) at the tank exterior (43) by means of an attachment flange (38) or other attachment means. The interior portion (34B) of the discharge pipe (34) has an interior end (35) configured for attachment to and fluid communication with a pipe segment (31) in order to extend the interior portion (34B) of the discharge pipe (34) along the vertically extending tank sidewall (42) in the tank interior (45).

Pipe segment (31) has an end (35A) that is configured for attachment to the swivel end segment (33A) of a submersible joint (33), such as a Chiksan® swivel joint manufactured by FMC Technologies, Inc. The swivel joint (33) has a discharge end (37) that is fitted with a choked nozzle (39). In this configuration, the choked nozzle (39) will be rotatably positionable within the interior (45) of the tank (40) by means of the swivel joint (33). The discharge pipe (34) can be adjusted, preferably by lengthening pipe segment (31), to allow the choked nozzle (39) of the nozzle section (12) to be extended adjacent to, and in use sweep slightly above, the tank floor (45A).

Figure 6A:
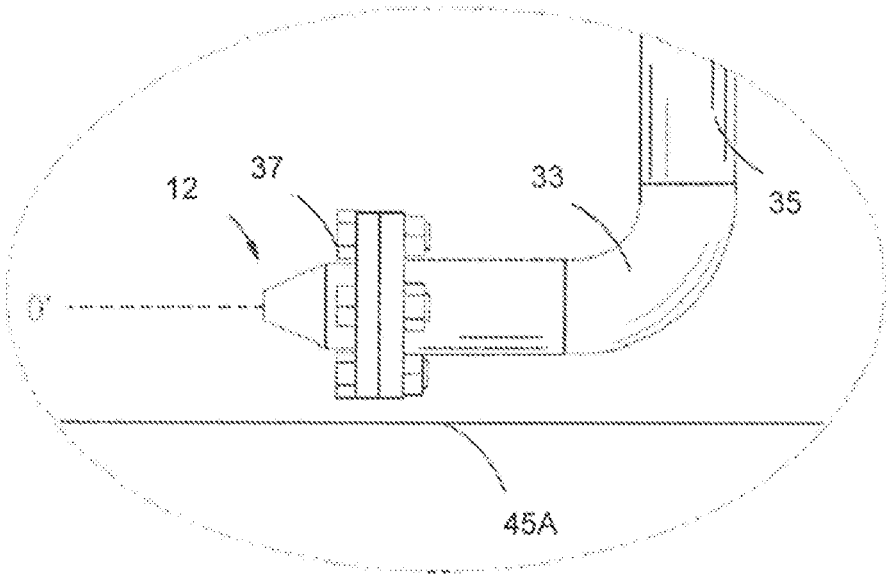
FIGS. 6A and 6B are a side partial cross-section view of the vertical articulation of the recirculation assembly shown in FIG. 1.
Figure 6B:
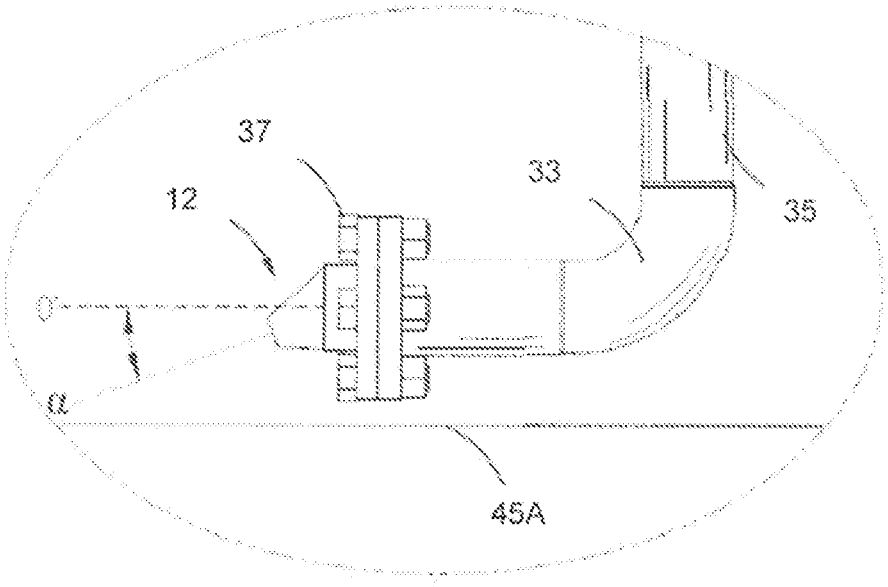

Detail area 6 shown in FIG. 4 refers to articulating of nozzle (39) which is shown in FIGS. 6A and 6B. FIG. 6A shows nozzle (39) in a horizontal position and FIG. 6B depicts an alternate position of nozzle (39) offset at a desired downward angle (all to follow the downward sloped surface of the tank floor (45A). Offsetting nozzle (39) at downward angle ($\alpha$) with respect to the horizontal, shown as 0°, allows improved mixing at the floor, without creating potential for damaging the floor by directing fluid forces at a relatively perpendicular angle to the tank floor (45A) or at an angle where the fluid forces generated by the nozzle (39) will cause wear or damage to the floor surface. The angular adjustment of nozzle (39) in combination with the adjustment of interior end (35) to position the nozzle section (12) to sweep slightly above the tank floor (45A) will provide a means to clear any adherent sludge from the surface of the tank floor (45A) while improving the mixing at the tank floor (45A) without creating a potential for damaging the floor by projecting high velocity fluids against the tank surface. The high velocity of the fluids projected by the nozzle section (12) may be directed in a jet or plume to dissolve and re-suspend accumulated sludge from a tank floor (45A).

The suction section (13) of the recirculation assembly (10) is comprised of a horizontally extending draw pipe (44) that is fixedly mounted to the vertically extending sidewall (42) of the storage tank (40). The draw pipe (44) extends through the tank sidewall (42) so that the draw pipe (44) protrudes into the interior (45) of the storage tank (40) in a direction generally perpendicular to the tank sidewall (42). The exterior portion (44A) of the draw pipe (44) extends away from the storage tank sidewall (42) on the tank exterior (43) of the storage tank (40) and the interior portion (44B) of the draw pipe (44) extends from the storage tank sidewall (42) into the tank interior (45) of the storage tank (40).

The suction section (13) is attached to a collection hose or pipe, shown as disposed vacuum line (26), for connecting the suction section (13) to the vacuum system (54) for producing a vacuum force ($\Delta$) at the suction section (13) to suction tank contents (81) including any adherent sludge freed by nozzle section (12).

The exterior portion (44A) of the draw pipe (44) has an exterior end (47) configured for attachment to the vacuum line (26) at the tank exterior (43) by means of an attachment flange (38) or other attachment means. The interior portion (44B) of the draw pipe (44) has an intake end (49) that is fitted with a vacuum nozzle or funnel (46). In this configuration, the funnel (46) will be capable of clearing obstructions from around opening (32) and suction tank contents (81) horn the tank (40) to collection reservoir (62) in order to redistribute the tank contents (81), which through the recirculation process any adherent sludge is agitated and re-suspended within the emulsion fluid, back through the nozzle (39) into the interior of the tank (40) by pump system (52).

Figure 5:
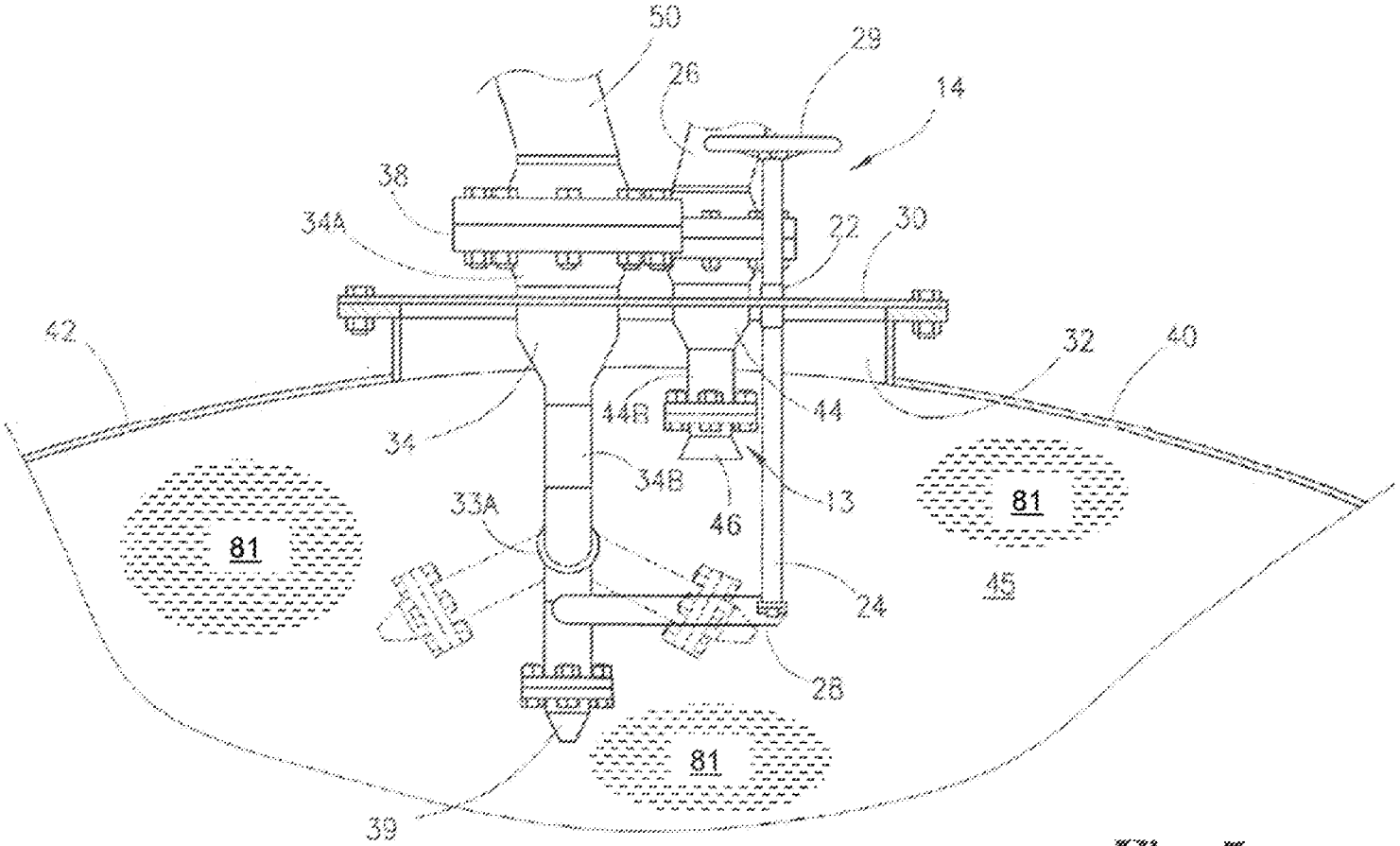
FIG. 5 is a top partial cross-section view of the above ground storage tank mixing assembly shown in FIG. 1.

FIG. 3, FIG. 4, and FIG. 5 show the control assembly (14) of the recirculation assembly (10). Control assembly (14) is fitted to the nozzle section (12) so that the position of the choked nozzle (39) by means of the swivel joint (33) can be manipulated by a user from the exterior of the storage tank (40). The control assembly (14) is generally comprised of a rotatable control shaft (24) that has an exterior end (23) extending generally perpendicular from the vertically extending sidewall (42) of the storage tank (40) and an interior end (25) that extends into the interior (45) of the storage tank (40). The control shaft (24) is fitted through a control bushing (22) mounted on the tank side rail (42) of the storage tank (40) at a position adjacent to the exterior portion (34A) of the discharge pipe (34).

The interior portion (25) of the control shaft (24) has a perpendicularly extending control rod (27) pivotally fitted to a steering linkage (28) that is pivotally attached to the swivel joint (33). The exterior end (23) of the control shaft (24) is fitted with a steer wheel (29) to facilitate rotation of the rotatable control shall (24). A handle projecting from the control shaft such as a crank, lever, or other device for tinning the control shaft (24) may be utilized as a replacement for the steering wheel (29). When interior end (35) is adjusted to place nozzle section (12) adjacent the tank floor (45A), interior portion (25) of the control shaft (24) will be proportionately adjusted in order to articulate swivel joint (33).

As shown in FIG. 5, a top partial cross-section view of a storage tank fitted with the articulating recirculation assembly (10), rotation of the control shaft (24) of the nozzle section (12) will move the control rod (27) and by the associated steering linkage (28) control position of the choked nozzle (39) and thereby the direction of flow from the choked nozzle (39) as the swivel joint (33) pivots about the swivel segment (33A).

The control assembly (14) and associated steering linkage (28) can be any suitable steering mechanism such as an eccentric gear drive, rack and pinion, cam, or wheel mechanisms. An automated device or a powered turning mechanism may also be incorporated into the control assembly (14). For example, the control assembly (14) may be fitted with a motor, such as an electric or hydraulic motor, to rotate the control shaft (24) or to otherwise manipulate the steering linkage (28) as a substitute for the manual steering wheel (29).

Figure 7:
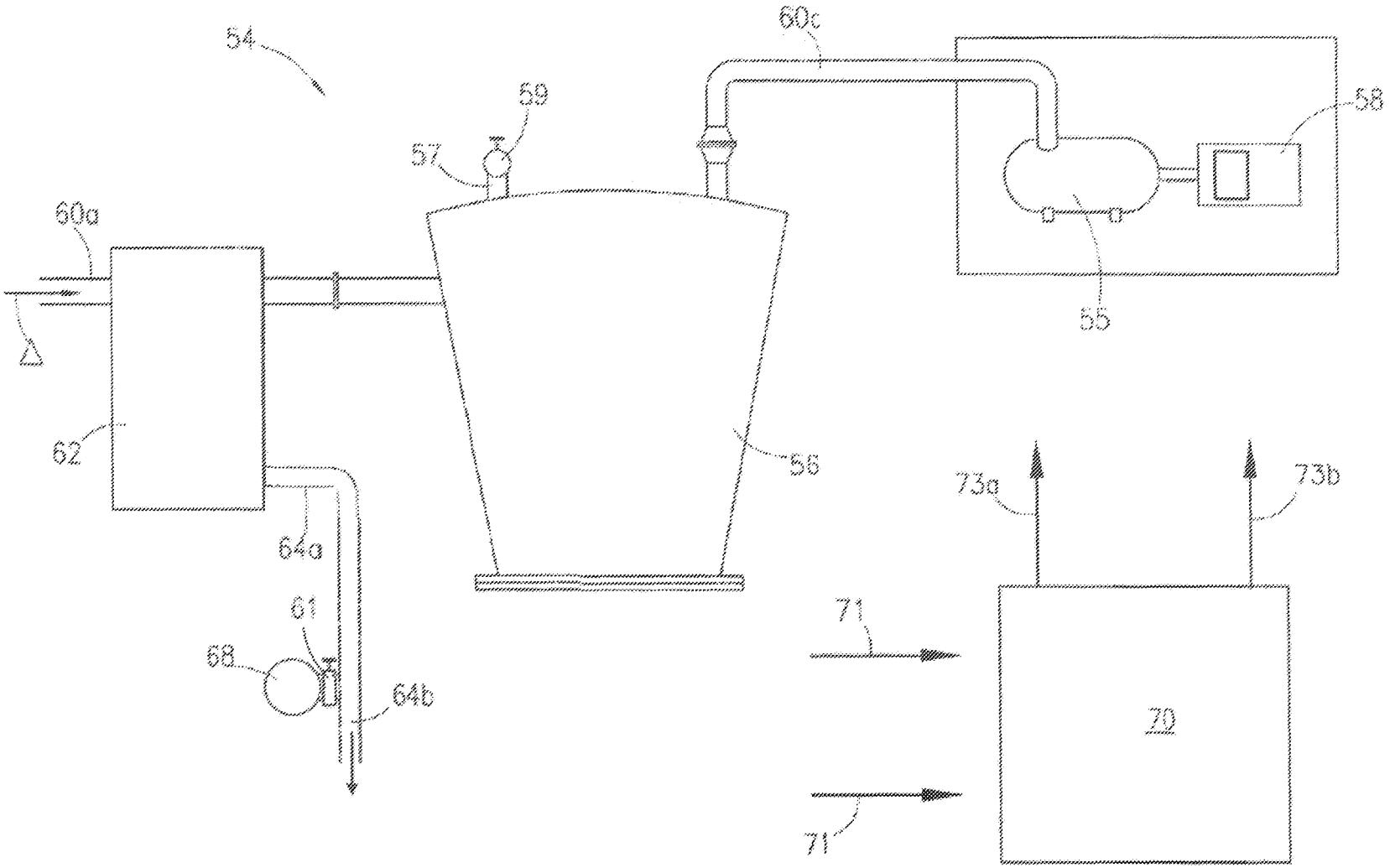
FIG. 7 is a schematic diagram of the vacuum system assembly of the above ground storage tank mixing assembly shown in FIG. 1.
Figure 8:
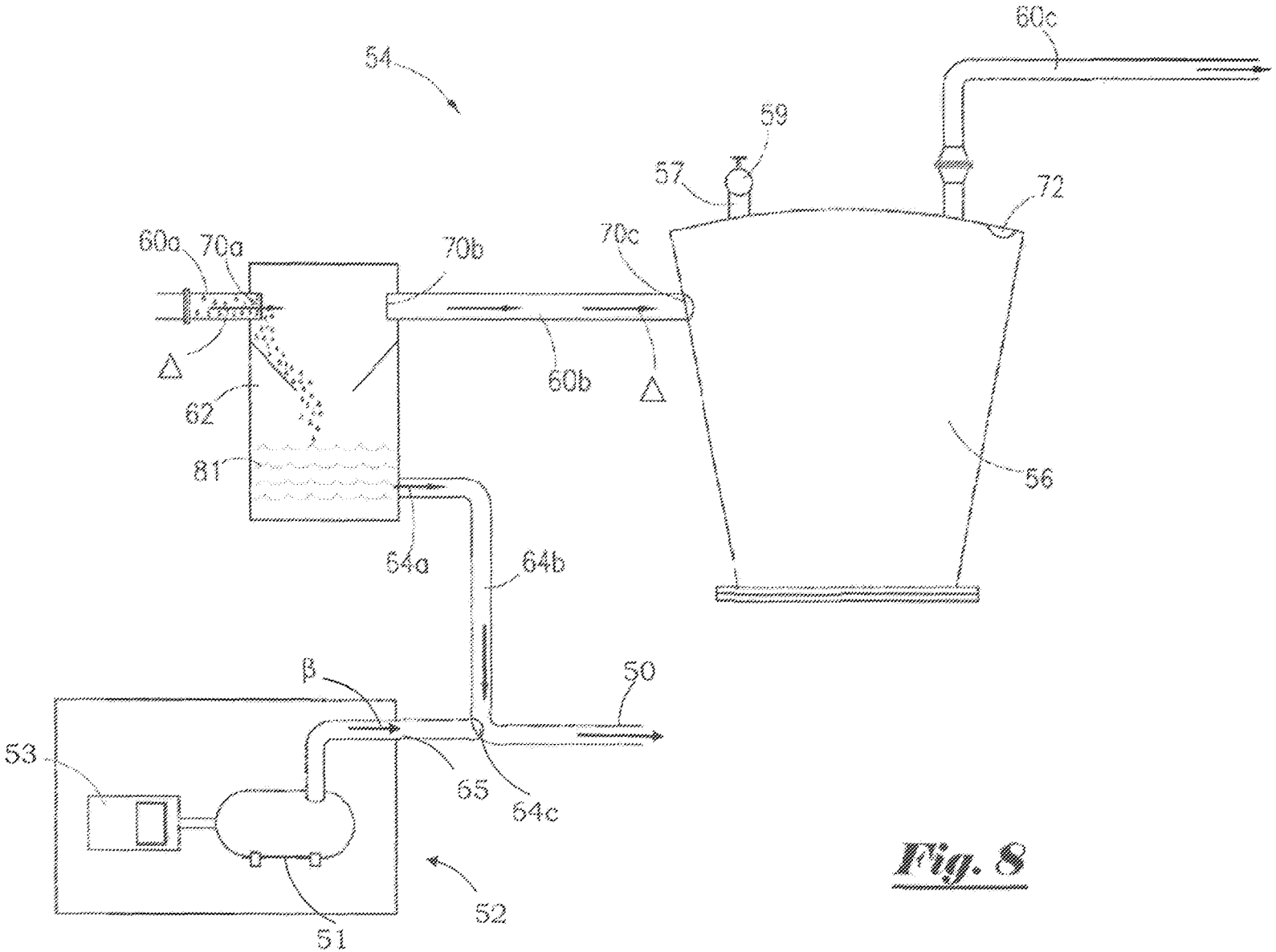
FIG. 8 is a schematic view of the vacuum assembly above ground storage tank mixing assembly.

As shown in FIGS. 7 and 8, the vacuum system (54) is comprised of a motor (55) and vacuum pump (55) connected to a vacuum tank (56) by an associated vacuum line (60*c*). The vacuum tank (56) is connected at entry (70*c*) to a vacuum line (60*b*) that is connected at entry (70*b*) to a collection reservoir (62). The collection reservoir (62) is further connected at entry (70*a*) to a fluids vacuum line (60*a*). The fluids vacuum line (60*a*) is connected to the vacuum pump (58) of vacuum line (26) shown in FIG. 1. When activated the vacuum pump (58) will create a vacuum within vacuum tank (56) via vacuum line (60*c*), a vacuum within the collection reservoir (62) is vacuum line (60*b*), and provide a desired suction force (Δ) at the funnel (46) via fluid vacuum line (60*a*) which is in communication with vacuum line (26). The suction force (Δ) at the funnel (46) will draw the tank contents (81) from the tank (40) into the collection reservoir (62).

The tank contents (81), drawn by suction through funnel (46) and vacuum line (26) into vacuum line (60*a*), is delivered through entry (70*a*) into the collection reservoir (62). The collected contents (81) will then spill into the collection reservoir (62) where it will be collected. The collection reservoir (62) is provided with an airtight fluids exit port (64) in communication with a pump system (52). Pump system (52) comprises a motor (53) and discharge pump (51) connected to fluid line (50). A dump pump (68) and dump valve (61) ma be provided with the collection reservoir (62) to facilitate collection of the tank contents (81) for transfer into smaller product containers for marketing and sale. The fluids dump valve (61) may be an automatic or manually operated valve such as a butterfly valve, a gate valve, or a ball valve.

The vacuum tank (56) may be provided with a vacuum control port (57) in communication with a vacuum control or vacuum relief valve (59). The vacuum relief valve (59) is used to regulate the suction created in the vacuum tank (56) and thus the suction created in the vacuum line (26) and ultimately the suction force (Δ) created at the funnel (46).

Pressure monitors (72) may be positioned at desired locations throughout the vacuum system (54) such as in the vacuum tank (56), the collection reservoir (62), or the vacuum line (26) to monitor and generate pressure signals (71). These pressure signals (71) may be delivered to a control panel (70) from which control signals (73*a*) may be generated and transmitted to the vacuum relief valve (59), pump (58), or motor (55) as necessary to regulate the vacuum created in the vacuum tank (56) and the quantity of fluids delivered to the collection reservoir (62) and to otherwise control the vacuum system (54). The control panel (70) may also be used to receive, generate, and transmit control signals (73*b*) to and from the fluids dump valve (61) of the collection reservoir (62) and to the dump pump (68) to regulate removal of the collected fluids from the collection reservoir (62).

A suction force (Δ) is then created at the funnel (46) by the vacuum system (54) and directed by the funnel (46) to suction the emulsion and any adherent or floating sludge of the tank contents (81) into the collection reservoir (62) of the vacuum system (54) to be reintroduced into the tank (40), thereby agitating the tank contents (81) to maintain the suspension of solids and heavy liquids within the fluid medium and clearing the area about the tank sidewall (42) of tank (40) of any adherent of floating sludge of tank contents (81) and agitating any sludge into resuspension into the fluid medium.

The vacuum system (54) is assembled with motor (55) connected to the vacuum pump (58), vacuum pump (58) connected to vacuum tank (56) via vacuum line (60*c*), collection reservoir (62) connected to vacuum tank (56) via vacuum line (60*b*), and vacuum line (26) connected to collection reservoir (62) via fluids vacuum line (60*a*).

With the vacuum system (54) attached to the vacuum line (26) of the suction section (13), the motor (55) and vacuum pump (58) is then activated to create a vacuum in vacuum tank (56). Creating a vacuum in the vacuum tank (56) will create a vacuum in the collection reservoir (62), a suction force (Δ) in fluid vacuum line (60*a*) and in vacuum line (26), and a suction force (Δ) at the funnel (46) whereby the tank contents (81) will be drawn through funnel (46), vacuum line (26), and fluid vacuum line (60*a*) into collection reservoir (62). Motor (53) of pump system (52) imparts a positive pressure (13) in fluid line (50) wherein the suctioned tank contents (81) collected within collection reservoir (62) will be driven back into tank (40) through nozzle section (12).

Controlling the suction force (Δ), positive pressure (β) and the flow of tank contents (81) into and out of the collection reservoir (62) may be accomplished by manually controlling the vacuum relief valve, the dump valve (61), the dump pump (68), motors (53, 55), vacuum pump (58), and pumping system (52). Controlling the suction force (Δ), positive pressure (β), and the flow of tank contents (81) into and out of the collection reservoir (62) may also be accomplished by automatically controlling the vacuum relief valve, the dump valve (61), the dump pump (68), motors (53, 55), vacuum pump (58), and pumping system (52) by generating control signals (71 and 73*a*, 73*b*) to and from the control panel (70) and the associated valves, pumps, and motors.

In use, the nozzle section (12) and suction section (13) of the apparatus (10) are permanently or removably mounted to the vertically extending sidewall (42) of the storage tank (40) containing contents (81). The discharge pipe (34) and draw pipe (44) extend through the tank sidewall (42) of tank (40) with the exterior portions (34A) of the discharge pipe (34) and (44A) of the draw pipe (44) on the exterior (43) of the storage tank (40) and an interior portions (34B) of the discharge pipe (34) and (44A) of the draw pipe (44) extend into the tank interior (45) of the storage tank (40). The swivel segment (33A) of the submersible swivel joint (33) is then attached to the end (35) of the interior portion (34B) of the discharge pipe (34) and the discharge end (37) of the swivel joint (33) is fitted with a choked nozzle (39). The nozzle section (12) is then positioned adjacent to the floor (45A) of tank (40). The steering linkage (28) of the control assembly (14) is then attached to the swivel joint (33) in a configuration that will allow rotation of the choked nozzle (39) about the centerline of the interior portion (34B) of discharge pipe (34) by means of the swivel joint (33) when the steering wheel (29) is turned to rotate the control shaft (24).

Flow from the choked nozzle (39) is accomplished by attachment of exterior portion (34A) of the discharge pipe (34) to the fluid line (50) at the tank exterior (43) by means of the attachment flange (38) or other attachment means. The swivel joint (33) with the attached control shaft (24) by means of the associated steering linkage (28) will then allow the nozzle (39), and any associated flow, to be directed to a desired position and location in the interior (45) of the storage tank (40) by rotation and manipulation of the control shaft (24) and associated steering linkage (28).

During the process of flow from choked nozzle (39) the emulsion fluid and any adherent sludge of tank contents (81) may be continually projected into tank contents (81) to impart rotational momentum and a re-suspending agitation force to the contents (81) contained within tank (40). At the same time, funnel (46) may be positioned to continually reclaim nearby tank contents by the suction of vacuum system (54) continually drawing tank contents (81) into funnel (46), through draw pipe (44), and into collection reservoir (62) where the contents (81) may then be driven by pumping system (52) back through nozzle section (12) to be recirculated back within storage tank (40).

Figure 9:
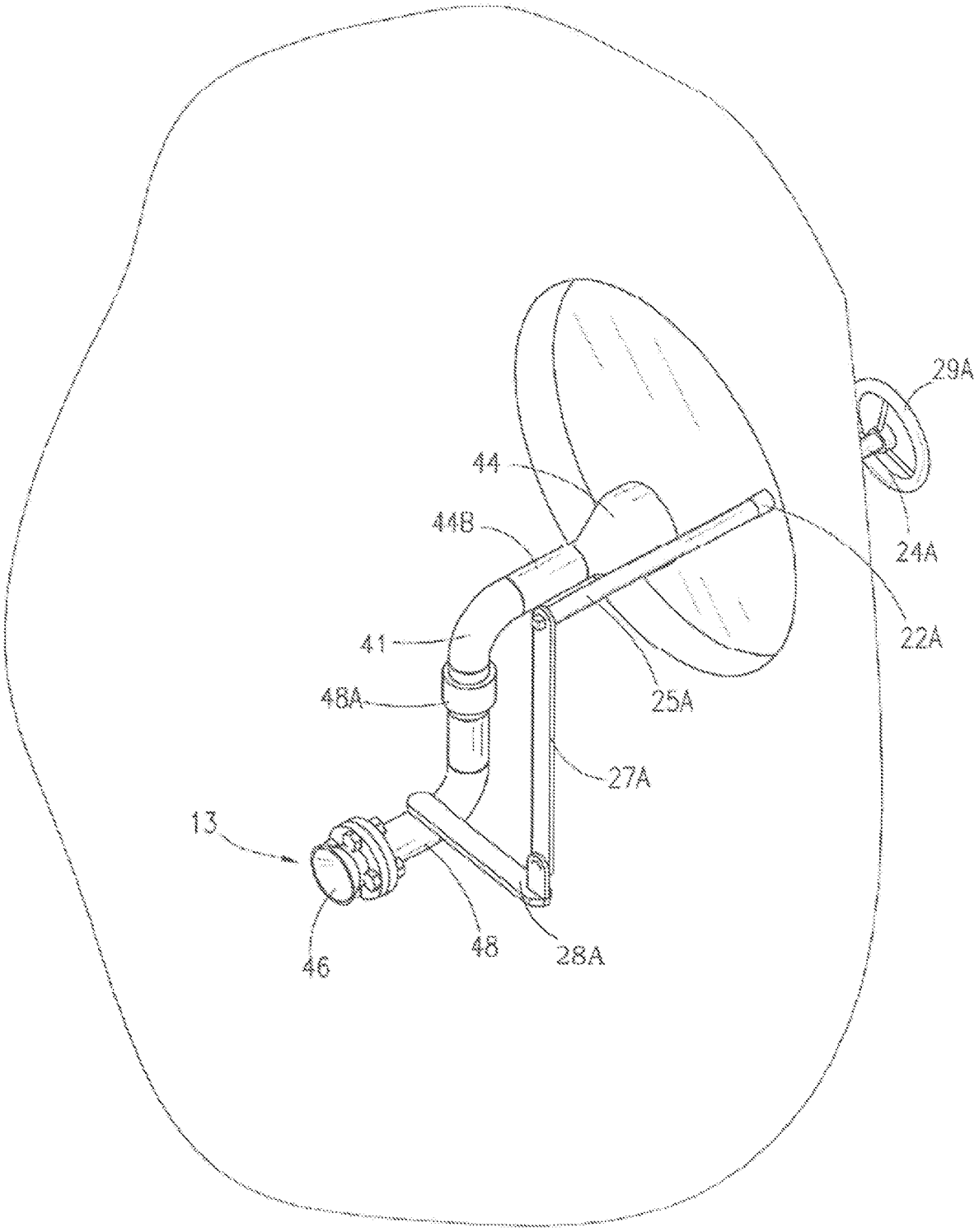
FIG. 9 is an isometric view of the suction section of the above ground storage tank mixing assembly being articulable above the tank floor of an above ground storage tank.

FIG. 9 depicts an isometric view at suction section (13) wherein nozzle section (12) has been omitted to best show the function of the suction, section (13) being articulable. As shown in FIG. 9, suction section (13) may be configured in the same manner as nozzle section (12) shown in FIGS. 3, 4, 5, 6A and 6B. In such a configuration suction section (13) will be provided with ninety degree pipe segments (41 & 48), a steering linkage (28A), control rod (27A), and a swivel joint (48A) so as to allow funnel (46) to be positioned adjacent to tank floor (45A) and articulated and positioned as desired, as described for nozzle section (12), to allow suction force (Δ) to draw in tank contents (81).

It is thought that the proposed method for maintaining solids and heavy liquids in fluid suspension within a bulk storage tank presented herein and many of its attendant advantages will be understood from the foregoing description. It is also thought that it will be apparent that various changes may be made in the form, construction and arrangement of the parts and steps of the method without departing from the spirit and scope of the invention or sacrificing all of its material advantages.

We claim:

1. A method for maintaining solids and liquid in a liquid suspension of an emulsion stored in an above ground storage tank comprising the steps of:

(a) providing said above ground storage tank, said above ground storage tank having a vertically extending sidewall defining a tank interior and a tank exterior and a downwardly sloped interior tank floor;

(b) providing a quantity of an emulsion of solids and liquid stored in said above ground storage tank;

(c) attaching a recirculation assembly to said above ground storage tank, said recirculation assembly comprising:

(i) a nozzle section, said nozzle section having a horizontally extending discharge pipe fixedly mounted to the vertically extending sidewall of said above ground storage tank, said discharge pipe having a section exterior to said tank sidewall and a section interior to said sidewall, said interior section of said nozzle section extending adjacent to and along said tank floor;

(ii) a suction section, said suction section having a horizontally extending draw pipe fixedly mounted to said vertically extending sidewall of said storage tank, said draw pipe having a section exterior to said tank sidewall and a section interior to said sidewall;

(iii) a first discharge pipe segment attached to said interior section of said discharge pipe of said nozzle section;

(iv) a second discharge pipe segment attached to said first discharge pipe segment of said nozzle section, said second discharge pipe segment having a submersible swivel joint;

(v) a nozzle attached to said second discharge pipe segment; and (d) providing a vacuum through said suction section thereby suctioning a portion of said quantity of said emulsion of solids and liquid stored in said above ground storage tank from said above ground storage tank;

(e) transferring said suctioned portion of said quantity of emulsion of solids and liquid to a collection reservoir;

(f) pumping said suctioned portion of said emulsion of solids and liquid from said collection reservoir through said nozzle section thereby recirculating said suctioned portion of said emulsion of solids and liquid back into said above ground storage tank; and (g) swiveling said nozzle section thereby agitating said quantity of said emulsion of solids and liquid held in said above ground storage tank with said returned suctioned portion of said emulsion of solids and liquid;

(h) adjusting said nozzle to be offset at a downward angle whereby said returned suctioned portion of said emulsion of solids and liquid is directed along the downward sloped surface of said tank floor of said above ground tank;

(i) pumping said returned suctioned portion of said emulsion of solids and liquid through said nozzle section thereby breaking up and circulates sludge at the bottom of said above ground storage tank; and (j) applying a vacuum through said suction section thereby suctioning said sludge through said draw pipe.

2. The method as recited in claim 1, including the additional step of swiveling said suction section.

3. The method as recited in claim 1, further comprising the step of providing a control assembly attached to said nozzle section whereby the position of said nozzle may be rotatably manipulated about said swivel joint from said exterior of said storage tank.

4. The method as recited in claim 3 wherein:

(a) said interior section of said suction section is adjustable to extend adjacent to said tank floor of said storage tank, said suction section comprising a first draw pipe segment in communication with said interior section of said draw pipe of said suction section and a second draw pipe segment in communication with said first draw pipe segment of said suction section, said second draw pipe segment having a submersible draw pipe swivel joint fitted with a funnel; and (b) further comprising the step of providing a funnel control assembly attached to said suction section whereby the position of said funnel may be rotatably manipulated about said draw pipe swivel joint from said exterior of said storage tank.

* * * * *